US006912742B1

(12) United States Patent
Wang

(10) Patent No.: US 6,912,742 B1
(45) Date of Patent: Jul. 5, 2005

(54) FAUCET ASSEMBLY

(76) Inventor: Hsiang-Shih Wang, P.O. Box 453, Taichung (TW)

( * ) Notice: Subject to any disclaimer, the term of this patent is extended or adjusted under 35 U.S.C. 154(b) by 57 days.

(21) Appl. No.: 10/674,531

(22) Filed: Oct. 1, 2003

(51) Int. Cl.[7] ..... E03C 1/042
(52) U.S. Cl. ..... 4/695; 4/678
(58) Field of Search ..... 4/695, 675–678; 137/801

(56) References Cited

U.S. PATENT DOCUMENTS 5,014,749 A * 5/1991 Humpert et al. ..... 137/801
6,301,728 B1 * 10/2001 Pilatowicz et al. ..... 4/695
6,363,549 B2 * 4/2002 Humpert et al. ..... 4/623
6,421,849 B1 * 7/2002 Gray ..... 4/675
6,457,191 B2 * 10/2002 Brandebusemeyer et al. .. 4/678
6,491,058 B1 * 12/2002 Wang ..... 137/359
6,668,393 B1 * 12/2003 Mascari et al. ..... 4/678

* cited by examiner

*Primary Examiner*—Charles E. Phillips
(74) *Attorney, Agent, or Firm*—Alan D. Kamrath; Nikolai & Mersereau, P.A.

(57) ABSTRACT

A faucet assembly comprises a main body, a fastening seat, a locating plate, a fastening bolt, and a lift rod. The fastening seat is formed of a base, an upper portion, and a lower portion. The fastening seat is mounted on the upper side of a sink such that the base is rested on the sink, and that the upper portion is disposed in the main body, and that the lower portion is put through a through hole of the sink. The fastening seat is provided with a water duct in communication with a water admission hole of a stem of the main body and with a water supply pipe. The locating plate is movably disposed in the underside of the sink such that the locating plate is driven by the fastening bolt to press against the sink. The fastening bolt is held by the fastening seat.

3 Claims, 3 Drawing Sheets

FAUCET ASSEMBLY

BACKGROUND OF THE INVENTION

1. Field of the Invention

The present invention relates generally to a faucet assembly comprising means to facilitate the fastening and the unfastening of a faucet main body with a sink.

2. Description of Related Art

The conventional faucet comprises a faucet main body and a fastening portion which is integrally made with the faucet main body. The conventional faucet is fastened to a sink in such a way that the fastening portion is fastened with the underside of the sink in conjunction with a fastener. In the event that the conventional faucet must be replaced, the main body and the fastening portion must be removed together in addition to a great deal of inconvenience of unfastening the fastener in the underside of the sink.

SUMMARY OF THE INVENTION

The primary objective of the present invention is to provide a faucet assembly which is so streamlined as to gain advantages over the conventional faucet.

The faucet assembly of the present invention comprises a main body, a fastening seat, a connection tube, a locating piece, a fastening bolt, and a lift rod. The fastening seat is mounted on the upper side of a sink for holding securely the main body which is in communication with a water supply pipe by the connection tube. The locating piece is provided with a threaded hole, which is engaged with the fastening bolt. The fastening bolt is provided with an axial through hole to accommodate the life rod. The faucet assembly is separated in its entirety from the sink by unfastening the fastening bolt with the threaded hole of the locating piece.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
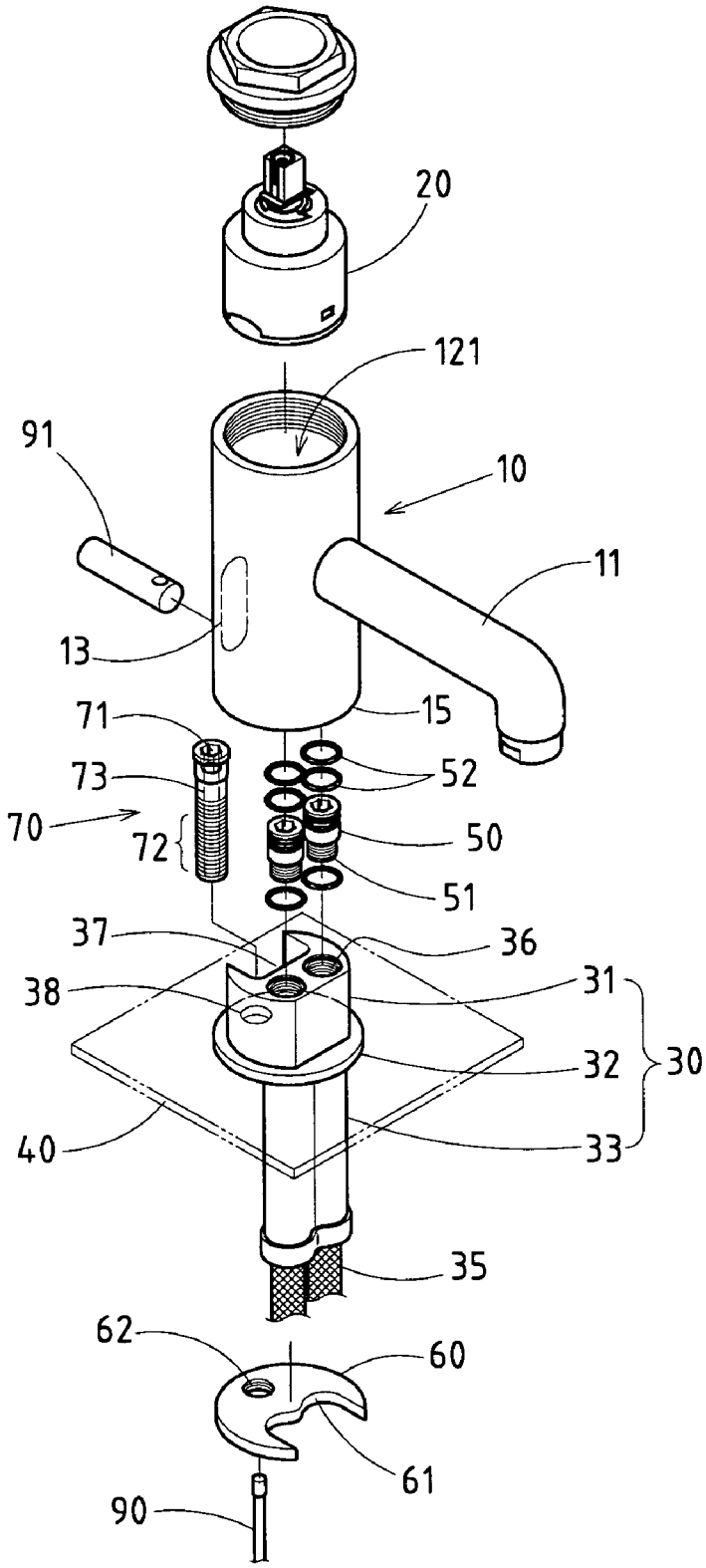
FIG. 1 shows an exploded view of the preferred embodiment of the present invention.
Figure 2:
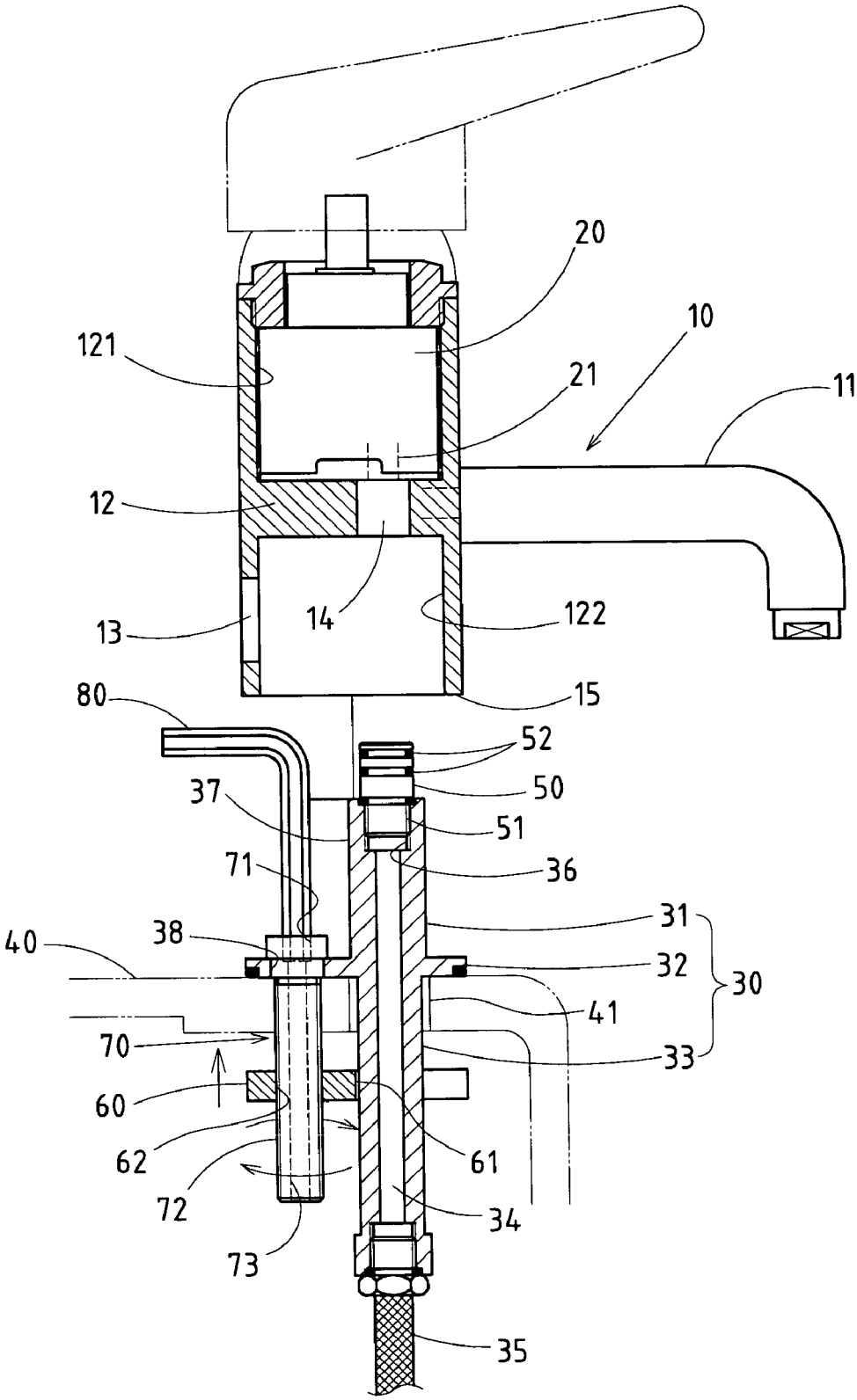
FIG. 2 shows a longitudinal sectional view of a partial exploded view of the preferred embodiment of the present invention.
Figure 3:
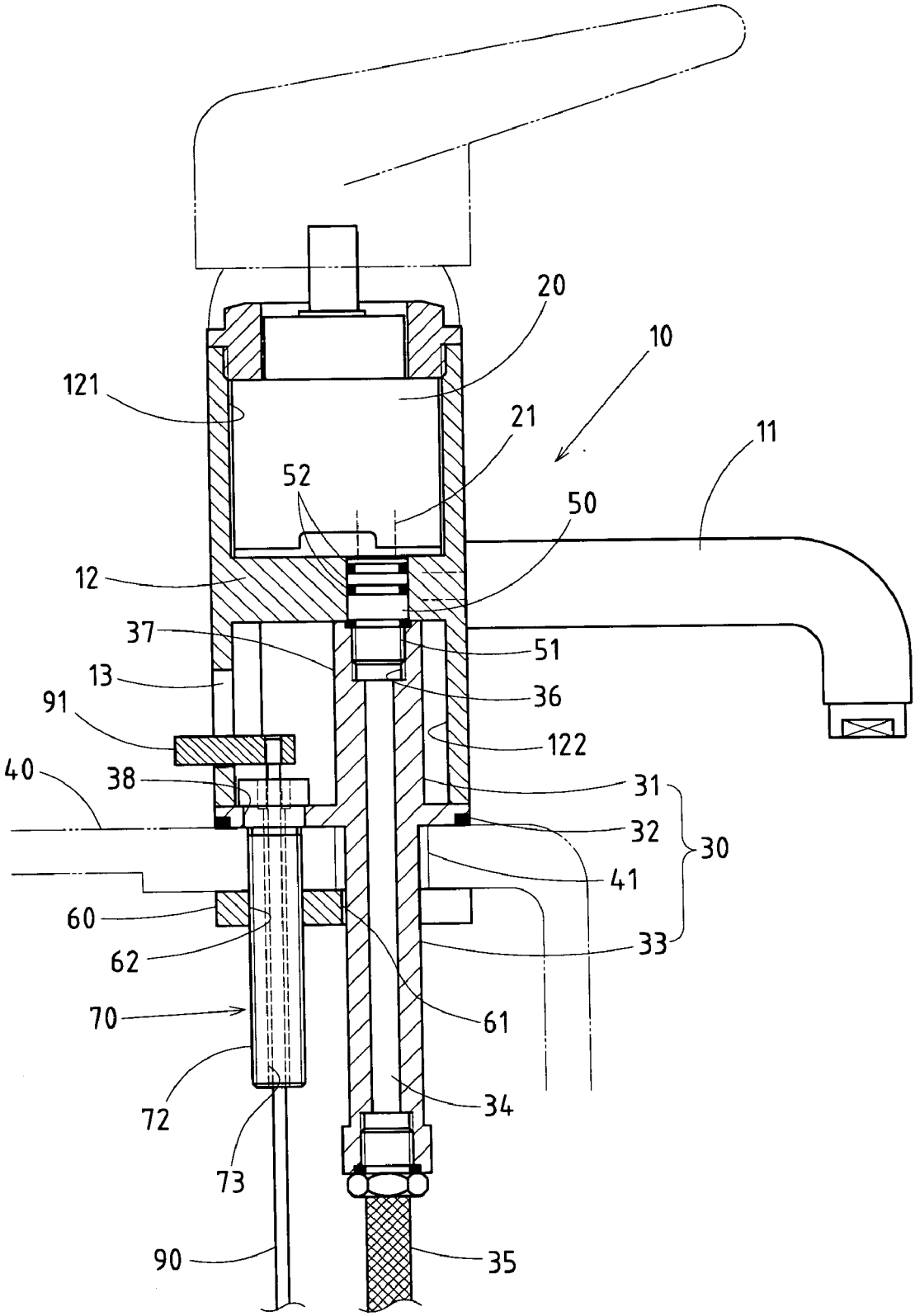
FIG. 3 shows a longitudinal sectional view of the preferred embodiment of the present invention in combination.

As shown in FIGS. 1–3, a faucet assembly embodied in the present invention comprises a main body 10, a stem 20, a fastening seat 30, at least one connection tube 50, a locating plate 60, a fastening bolt 70, and a lift rod 90.

The main body 10 is provided with a spout 11, and a partition 12 by which a hollow interior of the main body 10 is divided into an upper cell 121 and a lower cell 122. The upper cell 121 is used to mount the stem 20 which is provided with a water admission hole 21 in communication with the lower cell 122 via a through hole 14 of the partition 12. The lower cell 122 is provided in a side wall with a through slot 13.

The fastening seat 30 is formed of an upper portion 31, a base 32 from which the upper portion 31 is extended, a lower portion 33 extending from the underside of the base 32, and a water duct 34 extending from a bottom end through the base 32 and the upper portion 31 which is provided with a threaded hole 36 in alignment with the water duct 34. The upper portion 31 of the fastening seat 30 is provided with an indentation 37. The base 32 is provided with a through hole 38 corresponding in location to the indentation 37. The upper portion 31 is received in the lower cell 122 of the main body 10, with the base 32 pressing against a bottom 15 of the main body 10.

The connection tube 50 is provided at a lower end with a male threaded portion 51, which is engaged with the threaded hole 36 of the fastening seat 30, with the upper end of the connection tube 50 being inserted into the through hole 14 of the partition 12 of the main body 10 in conjunction with a plurality of washers 52.

The locating plate 60 is provided with a cut 61 shaped to accommodate the lower portion 33 of the fastening seat 30. The locating plate 60 is further provided with a threaded through hole 62 corresponding in location to the through hole 38 of the base 32.

The fastening bolt 70 is provided with a slotted head 71, a threaded shank 72, and an axial through hole 73. The threaded shank 72 is engaged with the threaded through hole 62 of the locating plate 60 via the through hole 38 of the base 32 of the fastening seat 30.

The lift rod 90 is provided at a top end with a handle 91 and is put through the axial through hole 73 of the fastening bolt 70 such that the handle 91 is extended out of the through slot 13 of the lower cell 122 of the main body 10. The handle 91 can be moved up and down in the through slot 13 so as to activate and deactivate the lift rod 90 which is connected at a bottom end to a pop-up stopper (not shown in the drawings.)

The faucet assembly of the present invention is fastened to a sink 40 in such a way that the base 32 of the fastening seat 30 is rested on the upper side of the sink 40, and that the lower portion 33 of the base 30 is put through a through hole 41 of the sink 40 to facilitate the connecting of the water duct 34 of the fastening seat 30 with a water supply pipe 35, and further that the locating piece 60 is disposed in the underside of the sink 40. The fastening bolt 70 is turned with a tool 80 which is engaged with the slotted head 71 of the fastening bolt 70. As the fastening bolt 70 is turned, the locating plate 60 is moved upward to press against the underside of the sink 40, so as to locate securely the faucet assembly of the present invention on the sink 40. In the meantime, the lower portion 61 of the locating plate 60 is located in the cut 61 of the locating plate 60.

In the process of separating the main body 10 from the remainder of the faucet assembly of the present invention, the lift rod 90 and the handle 91 are first removed to facilitate the separating of the main body 10 from the upper portion 31 of the fastening seat 30, with the remainder of the faucet assembly being fastened with the sink 40. In another words, the fastening seat 30 is compatible with the main body 10 of various external forms. In addition, the way that the faucet assembly of the present invention is fastened with the sink is greatly simplified.

The embodiment of the present invention described above is to be regarded in all respects as being illustrative and nonrestrictive. Accordingly, the present invention may be embodied in other specific forms without deviating from the spirit thereof. The present invention is therefore to be limited only by the scopes of the following claims.

I claim:

1. A faucet assembly comprising:

a main body provided with a spout and further provided in a hollow interior thereof with a partition by which the hollow interior is divided into an upper cell and a lower cell, said partition being provided with a through hole in communication with a water admission hole of a stem which is disposed in said upper cell, said lower cell being provided in a side wall with a through slot;

a fastening seat formed of a base, an upper portion extending from an upper side of said base, and a lower portion extending from an underside of said base, said fastening seat being provided with at least one water duct extending through said lower portion, said base, and said upper portion, said upper portion being provided at an upper end with at least one threaded hole in alignment with said water duct, said upper portion being further provided with an indentation, said base being provided with a through hole corresponding in location to said indentation whereby said fastening seat is secured to the upper side of a sink such that said base is rested on the upper side of the sink, and that said upper portion is disposed in said lower cell of said main body, and that said lower portion is put through a through hole of the sink, and further that said water duct of said fastening seat is in communication with said through hole of said partition of said main body by at least one connection tube fastened at one end with said threaded hole of said upper portion, with said water duct being connected at a bottom end with a water supply pipe;

a locating plate provided with a threaded through hole and disposed in the underside of the sink such that said threaded through hole is aligned with said through hole of said base of said fastening seat;

a fastening bolt provided with a head, a threaded shank, and an axial through hole, said threaded shank being engaged with said threaded through hole of said locating plate via said through hole of said base of said fastening seat whereby said head of said fastening bolt is turned by a tool to cause said locating plate to press against the underside of the sink; and a lift rod provided at a top end with a handle, and connected at a bottom end to a pop-up stopper of the sink whereby said lift rod is movably put through said axial through hole of said fastening bolt such that said handle is extended out of said lower cell of said main body via said through slot of said lower cell.

2. The faucet assembly as defined in claim 1, wherein said locating plate is provided with a cut whereby said cut is shaped to embrace said lower portion of said fastening seat.

3. The faucet assembly as defined in claim 1, wherein said head of said fastening bolt is slotted to enable said head to engage with a slotted screwdriver.

* * * * *